US010873153B2

(12) United States Patent
Denzinger

(10) Patent No.: US 10,873,153 B2
(45) Date of Patent: Dec. 22, 2020

(54) PLUG-IN CONNECTOR

(71) Applicant: Molex, LLC, Lisle, IL (US)

(72) Inventor: Andrea Denzinger, Rottenburg (DE)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/487,836

(22) PCT Filed: Feb. 23, 2018

(86) PCT No.: PCT/EP2018/054577

§ 371 (c)(1),
(2) Date: Aug. 22, 2019

(87) PCT Pub. No.: WO2018/154074

PCT Pub. Date: Aug. 30, 2018

(65) Prior Publication Data

US 2020/0059035 A1 Feb. 20, 2020

(30) Foreign Application Priority Data

Feb. 24, 2017 (DE) ..... 20 2017 101 060 U

(51) Int. Cl.
*H01R 13/52* (2006.01)
*H01R 4/18* (2006.01)
(Continued)

(52) U.S. Cl.
CPC ..... *H01R 13/521* (2013.01); *H01R 4/183* (2013.01); *H01R 13/42* (2013.01); *H01R 13/53* (2013.01); *H01R 13/6581* (2013.01)

(58) Field of Classification Search
CPC ..... H01R 13/521; H01R 4/183; H01R 13/42
(Continued)

(56) References Cited

U.S. PATENT DOCUMENTS 4,159,860 A * 7/1979 Broad ..... H02G 15/064 174/73.1
4,736,999 A * 4/1988 Marks ..... H01R 13/6456 439/218

(Continued)

FOREIGN PATENT DOCUMENTS

DE 102005037789 A1 2/2007
DE 202007011829 U1 10/2007

(Continued)

OTHER PUBLICATIONS

International Search Report and Written Opinion received for PCT application No. PCT/EP2018/054577, dated Apr. 16, 2018, 8 pages. (Including English Translation).

*Primary Examiner* — Alexander Gilman

(57) ABSTRACT

A plug-in connector for a high-current application in accordance with the present disclosure comprises an electrically conductive plug-in contact element and an electrically insulating housing. The housing is formed with at least one through-opening forming a plug-in contact element holder for receiving the plug-in contact element. The plug-in contact element holder surrounds the plug-in contact element at least in regions. A seal is provided in the region in which the plug-in contact element holder surrounds the plug-in contact element so that the seal seals the plug-in contact element holder to the plug-in contact element. The plug-in contact element has a crimp section for establishing an electrical and mechanical connection to a cable, wherein the plug-in contact element is formed from a crimp element and a plug-in element, which are connected to one another by means of a press fit.

11 Claims, 5 Drawing Sheets

(51) Int. Cl.
*H01R 13/42* (2006.01)
*H01R 13/53* (2006.01)
*H01R 13/6581* (2011.01)

(58) Field of Classification Search
USPC ..... 439/587
See application file for complete search history.

(56) References Cited

U.S. PATENT DOCUMENTS 5,368,504 A * 11/1994 Muzslay ..... H01R 4/646 439/471
5,662,500 A * 9/1997 Yeah ..... H01R 13/44 439/181
5,667,413 A * 9/1997 Trafton ..... H01R 13/187 439/271
5,916,002 A * 6/1999 Gottschalk ..... H01R 13/53 439/839
6,544,073 B2 * 4/2003 Kieninger ..... H01R 11/287 439/620.28
7,029,335 B2 * 4/2006 Osada ..... H01R 13/447 439/466
7,892,026 B2 * 2/2011 Langhoff ..... H01R 13/03 439/271
7,950,968 B2 * 5/2011 Qian ..... H01R 9/03 439/466
8,092,409 B2 * 1/2012 Mros ..... A61M 39/12 285/124.2
8,303,352 B2 * 11/2012 Hangartner ..... H01R 13/187 439/843
8,808,039 B2 * 8/2014 Mott ..... B60L 53/31 439/843
8,939,786 B2 * 1/2015 Rosenberger ..... H01R 13/502 439/352
9,680,247 B1 * 6/2017 Glick ..... H01R 13/187
2011/0177722 A1 * 7/2011 Casses ..... H01R 13/187 439/660

FOREIGN PATENT DOCUMENTS

DE 102006036812 A1 2/2008
DE 102007009562 A1 9/2008
DE 102008061934 A1 7/2010
DE 102009041919 A1 3/2011
DE 102009053778 A1 6/2011
DE 112014002122 T5 1/2016
DE 102014112701 A1 3/2016
EP 0568927 B1 8/1997
EP 2362499 A1 8/2011
WO 2018/154074 A1 8/2019

* cited by examiner

PLUG-IN CONNECTOR

RELATED APPLICATIONS

This application claims priority to PCT Application No. PCT/EP2018/054577, filed on Feb. 23, 2018, which further claims priority to German Application No. 202017101060.0, filed on Feb. 24, 2017, which are incorporated herein by reference in their entirety.

TECHNICAL FIELD

The present disclosure relates to a plug-in connector, in particular for a high-current application.

BACKGROUND ART

According to IEC 60264-1, potential equalization must take place for electrical machines, such as welding or cutting machines which are operated with high current. The electrical line for potential equalization should be designed for currents of up to at least 40 A. This means that the electrical line must have a cross-sectional area of at least 10 $mm^2$ throughout. This applies both to the wire of the electrical line and to the plug-in contact.

In industrial environments, there may be areas where there is significant moisture. Electrical machines are separated from such damp areas by housings or walls, with cables having to be passed through the corresponding housing walls or the corresponding walls. Plug-in elements, into which a plug-in connector can be inserted, are often arranged on such housings in order to enable an electrical connection from outside the housing to inside the housing. The plug-in connector should be as watertight and dust-tight as possible (IP66; DIN 40050 and IEC 529).

DE 10 2008 061 934 A1 discloses a high-current plug-in connector with a housing in which a plug-in contact element is arranged. The plug-in contact element is formed with a sleeve-shaped crimp connection, at which a cable can be electrically and mechanically connected to the plug-in contact element. A sealing ring is arranged on the end face of the housing so that the housing is sealed to a housing of the mating plug-in connector when plugged into a mating plug-in connector.

DE 10 2009 041 919 A1 discloses a similar high-current plug-in connector, which is also provided with a seal on the end face, which is formed as a bellows.

DE 10 2007 009 562 A1 describes a high-current plug-in contact that has an electrically conductive plug-in contact element and an electrically insulating housing. The housing is sealed against its surroundings to prevent the ingress of liquids and dust. The seal can be formed by the protective housing itself by the protective housing being made of a material that is able to connect to an outer sheath insulation of a line of the high-current plug-in contact. The connection can be effected, for example, by fusing.

Additional plug-in connectors for high-current applications can be found, for example, in EP 0 568 927 B1, DE 10 2006 036 812 A1, DE 10 2009 053 778 A1 and DE 10 2014 112 701 A1.

DE 10 2005 037 789 A1 discloses a plug-in connector assembly for establishing and disconnecting at least one electrical connection with another complementary plug-in connector assembly. The plug-in connector assembly comprises an electrically conductive plug-in contact element formed from a contact connecting bolt and a contact element connectable thereto. The plug-in contact element can be arranged in a through-opening of a contact carrier. At its opposite end to the plug-in direction, the connecting bolt has a connection region that can be formed as a crimp connection. At the front end of the connecting bolt in the plug-in direction is provided a threaded hole, into which a threaded section of the contact element can be screwed after the connecting bolt has been arranged in the contact carrier. Furthermore, at its front end in the plug-in direction, the connecting bolt can be provided with a radially circumferential annular groove (variant A), with a flanging region (variant B) or with latching elements (variant C). According to variant A, a ring can be inserted from a front side of the contact carrier into the through-opening and is pressed into the ring groove via the front side of a connection region of the connecting bolt. Since the connecting bolt has a circumferential latching edge, which strikes against a corresponding edge of the contact carrier, the connecting bolt is, by means of the ring, fixed in the contact carrier in a stationary manner or against displacement in or counter to the plug-in direction. According to variant B, a radially circumferential flange edge is provided, which is flanged after the connecting bolt has been inserted into the contact carrier and in this manner fixes the connecting bolt in the contact carrier. According to variant C, latching elements are provided, which engage behind or in the same edge in the contact carrier by the ring also being arranged or the flanging being carried out in its region. Slits in the form of grooves are introduced in a rear side of the contact carrier, wherein a part of a central region of the connecting bolt engages in these slots so that anti-rotation protection is formed. The contact elements are sealed to the contact carrier by appropriate sealing rings. The sealing element rests against another radially circumferential edge formed in the through-opening and located at the front in the plug-in direction. The seal should serve both to seal the connection region between the contact element and the connecting bolt and to mechanically fix the contact element, wherein a limited movement of the contact elements transverse to their longitudinal axis is nevertheless possible, since, after the seal has been applied to the contact elements, the contact element must still be movable in relation to the contact carrier in order to screw the contact element or a corresponding threaded pin of the contact element into the connecting bolt.

DE 20 2007 011 829 U1 discloses a contact element. This contact element comprises a connecting section, a socket section and an annular latching element. The connecting element is connected to the socket section by flanging, wherein, in the region between the connecting element and contact element, the annular latching element with corresponding latching lugs is provided in order to fix the contact element in a plug-in housing.

EP 2 362 499 A1 discloses a plug-in connector for a charging cable, which plug-in connector is intended to be used in particular in the field of electromobility. This plug-in connector may have a contact element formed as one piece, wherein an outer wall of this contact element is sealed to an insulating body of the contact element by means of a corresponding sealing element. At its opposite end to the plug-in direction, the contact element can have a crimp connection for connection to a cable.

SUMMARY

As explained above, there are already various high-current plug-in connectors that can also have seals in order to be sealed against the ingress of moisture. With most of the known high-current plug-in connectors, only the end faces of the plug-in connectors that are plugged together are sealed. With the plug-in connector according to DE 10 2007 009 562 A1, the housing of the plug-in connector is also sealed to the sheathing of the line by fusing the housing with the sheathing of the line.

The inventors of the present disclosure realized that sealing the end faces of the plug-in connectors is often not sufficient, since moisture can also pass through along the line and a plug-in contact element located in the plug-in connector. However, sealing the line by fusing it with the housing is highly complex. Such fusing of the housing with the sheathing does not allow such a plug-in connector to be easily assembled on the line.

The disclosure is therefore based on the object of creating an easy to assemble plug-in connector for a high-current application.

An additional object of the present disclosure is to create a plug-in connector for a high-current application that is very well sealed against the passage of dust and moisture.

An additional object of the present disclosure is to create a plug-in connector for a high-current application that can be manufactured cost-effectively.

An additional object of the present disclosure is to create a plug-in connector for a high-current application that allows a reliable, dust-proof and moisture-proof plug-in connection in the long term.

One or more of the above objects are achieved by a plug-in connector with the features of the independent claim. Advantageous designs are indicated in the respective subclaims.

A plug-in connector for a high-current application in accordance with the present disclosure comprises an electrically conductive plug-in contact element and an electrically insulating housing. The housing is formed with at least one through-opening forming a plug-in contact element holder for receiving the plug-in contact element. The plug-in contact element holder surrounds the plug-in contact element at least in regions. A seal is provided in the region in which the plug-in contact element holder surrounds the plug-in contact element so that the seal seals the plug-in contact element holder to the plug-in contact element. The plug-in contact element has a crimp section for establishing an electrical and mechanical connection to a cable, wherein the plug-in contact element is formed from a crimp element and a plug-in element that are connected to each other by means of a press fit.

With this plug-in connector, the plug-in contact element holder, which is formed as a through-opening, is sealed to the plug-in contact element by means of the seal so that moisture is not able to pass through the plug-in contact element holder.

Furthermore, the disclosure provides that the plug-in contact element in accordance with the present disclosure is formed in two parts, the crimp element and the plug-in element. For connecting in a frictional and/or force-fitting manner, and in particular for forming a press fit between these two elements, the crimp element can have a cylindrical recess into which a cylindrical section of the plug-in element is introduced. The cylindrical recess of the crimp element and the cylindrical section of the plug-in element are then connected to each other via the press fit.

Alternatively, the cylindrical section (shaft) can also be formed on the crimp element, and the cylindrical recess (hole) can also be formed on the plug-in element.

Within the framework of the present disclosure, an interference fit or press fit is understood to be a fit with which the maximum dimension of the diameter of the cylindrical recess or hole is in any event smaller than the minimum dimension of the diameter of the cylindrical section of the shaft.

Such a press fit between the crimp element and the plug-in element is made or produced before the plug-in contact element is inserted into the insulating body of the housing. In this respect, it is provided that the plug-in contact element is inserted into the housing from the rear in the plug-in direction.

The plug-in contact element can be fixed in the insulating body by providing corresponding latching elements.

In contrast thereto, it is, for example, provided in the plug-in connector assembly in accordance with DE 10 2005 037 789 A1 that, firstly, a connecting bolt is inserted from behind in the plug-in direction into a through-opening of a contact carrier and then the connecting bolt is inserted from the front into one of the through-openings of the contact carrier counter to the plug-in direction and thereafter it is screwed into the connecting bolt by means of a threaded connection.

Such a procedure is much more complex in production than simply inserting the compressed plug-in contact element into the insulating body from behind in the plug-in direction in accordance with the present disclosure since, in accordance with the disclosure, no rotary movements have to be carried out during assembly in the insulating body or in the housing. The two elements are simply connected to each other before being inserted into the insulating body or housing.

Such rotary movements are much more complex in terms of production technology. This also results in a not insignificant mechanical load on the seal, and there is a danger of twisting a corresponding seal by such a rotary movement in such a manner that the sealing effect is impaired and/or even damaged and no longer has any sealing effect In the plug-in connector in accordance with the disclosure, it is provided that the seal for sealing the plug-in contact element to the insulating body is arranged in the region of a crimp section and behind the latching elements in the plug-in direction. In this manner, when the seal is inserted from behind in the plug-in direction of the crimp section into the insulating body, it is loaded only once briefly in the axial direction. In this case, there is no risk of twisting or damaging the seal.

A connection between the crimp element by means of a press fit, for example via a cylindrical recess and a cylindrical section, is therefore particularly advantageous since the production effort is lower and a reliable sealing effect is ensured.

The plug-in connector is assembled by clamping the plug-in contact element on which the seal is arranged to a wire of a cable and then plugging it into the plug-in contact holder. Internal tests were carried out in which, instead of a crimp section, a solder section was used to solder the wires of the cables to the plug-in contact element. A crimping tool, which requires significant space, is used for crimping. Soldering requires less space so that, in case of a multipolar plug-in connector, several wires can easily be connected with several plug-in contact elements. If the plug-in contact elements were to be connected to the wire using a solder connection, the plug-in contact elements could also be arranged in the housing and only then could the wires be fixed to the plug-in elements using the solder connection. However, these internal tests have shown that soldering can damage both the insulating parts of the housing and the seal located on the plug-in contact element. Since the plug-in contact elements are preferably formed for high-current applications and must therefore have a large cross-sectional area, they conduct heat very well. Correspondingly thick wires have to be soldered to the plug-in contact element with a corresponding amount of solder, which in turn requires a high amount of heat. This heat is conducted through the plug-in contact elements and can damage the seal. Therefore, such a solder connection is disadvantageous. In principle, the seal could initially be arranged in the plug-in contact element holder, and the plug-in contact element could then be inserted. However, this is not practicable since the seal is much easier to place on the plug-in contact element and then both are inserted together into the plug-in contact element holder.

Furthermore, the stranded wire or the line connected to the plug-in contact element can be formed as a 40 A high-current contact with a cross-section of at least 10 $mm^2$. If such a large cross-section were soldered to the contact element, the parts of the housing formed from plastic and potentially also the seal would also be damaged due to the high heat input.

Since crimping to connect the plug-in contact element to a wire of a cable can be carried out outside the electrically insulated housing and the plug-in contact element fixed to the cable is then inserted into the plug-in contact element holder, there is sufficient space available to attach a crimping tool to the crimp section of the plug-in contact element. Even if the plug-in connector is formed to be multipolar with several plug-in contact elements, the individual plug-in contact elements can be connected one after the other with one wire each of one or more cables by crimping, and can be plugged into the respective plug-in contact element holder. This ensures that the seal is not damaged and that the plug-in contact element holder is properly sealed.

Nevertheless, instead of a crimp section, a corresponding solder section can also be provided in order to connect a cable to the plug-in contact element.

The plug-in connector can also have several plug-in contact element holders. A plug-in contact element is then respectively arranged in each plug-in contact element holder, wherein, in each case, a seal is provided for sealing the plug-in contact element holder to the respective plug-in contact element. The individual plug-in contact elements are formed in accordance with the above designs.

The seal is preferably an O-ring.

The housing has a plug-in surface. The plug-in connector can be plugged together with a mating plug-in connector. In the plugged-together or connected state, the plug-in surface of the plug-in connector points in the direction of the mating plug-in connector. Arranged on the plug-in surface is a circumferential plug-in-surface seal, which in the mated state rests against a corresponding mating surface. The mating surface can be a plug-in surface of the mating plug-in connector. However, the mating surface can also be a wall of a housing to which the mating plug-in connector is attached.

Preferably, the plug-in contact element and the corresponding plug-in contact element holder are formed with a positive fit so that the plug-in contact element is arranged in the plug-in contact element holder so as to be secure against rotation. For this purpose, the plug-in contact element can have, for example, an approximately cylindrical section flattened with flat surfaces, and the plug-in contact element holder can be shaped correspondingly for this purpose so that the positive fit is formed as a result.

The plug-in contact element can have a latching element and the corresponding plug-in contact element holder can have a mating latching element so that the plug-in contact element is held in a manner latched in the plug-in contact holder. The latching element of the plug-in contact element is preferably a latching spring, which protrudes elastically in the plug-in direction of the plug-in connector to the rear, radially to the outside. The mating latching element of the plug-in contact element holder is preferably an undercut in the plug-in direction, to which the latching spring or springs of the plug-in contact element can latch.

The plug-in contact element can have a pin or a socket.

The plug-in contact element preferably has a cross-sectional area of at least 5 $mm^2$ and in particular at least 8 $mm^2$. In particular, the plug-in contact element is formed with a cross-sectional area of at least 10 $mm^2$. The crimp section is formed in such a manner that it can enclose wires with a corresponding diameter.

The plug-in contact element can be formed of two parts, a crimp element or a solder element and a plug-in element, which are connected to each other in a frictional and/or force-fitting manner. A two-part design of the plug-in contact element is advantageous in that the material from which the crimp element is formed is essentially formed from a plastically deformable material, whereas the plug-in element, in particular when formed as a socket, is formed from an essentially elastically deformable material.

The plug-in contact element can also be formed in one piece. A one-piece design of the plug-in contact element can be particularly advantageous if the plug-in element is formed as a pin.

Due to the two-part design of the plug-in contact element, extremely flexible pins and/or sockets can be provided as required. According to a modular design principle, different connection ports can be freely selected and combined with each other.

Furthermore, the plug-in connector in accordance with the disclosure can have a cover hood that can be attached to the housing of the plug-in connector using a chain, for example. This cover hood forms a waterproof protective cap when the plug-in connector is in the state of not being plugged in.

BRIEF DESCRIPTION OF DRAWINGS

The present disclosure is described in more detail below by way of example with reference to the figures. These show.

DETAILED DESCRIPTION OF THE PREFERRED EMBODIMENTS

According to the disclosure, a plug-in connector 1, in particular for a high-current application, is provided with an electrically conductive plug-in contact element 2 and at least one electrically insulating housing 3 (FIGS. 5 to 12).

Figure 8:
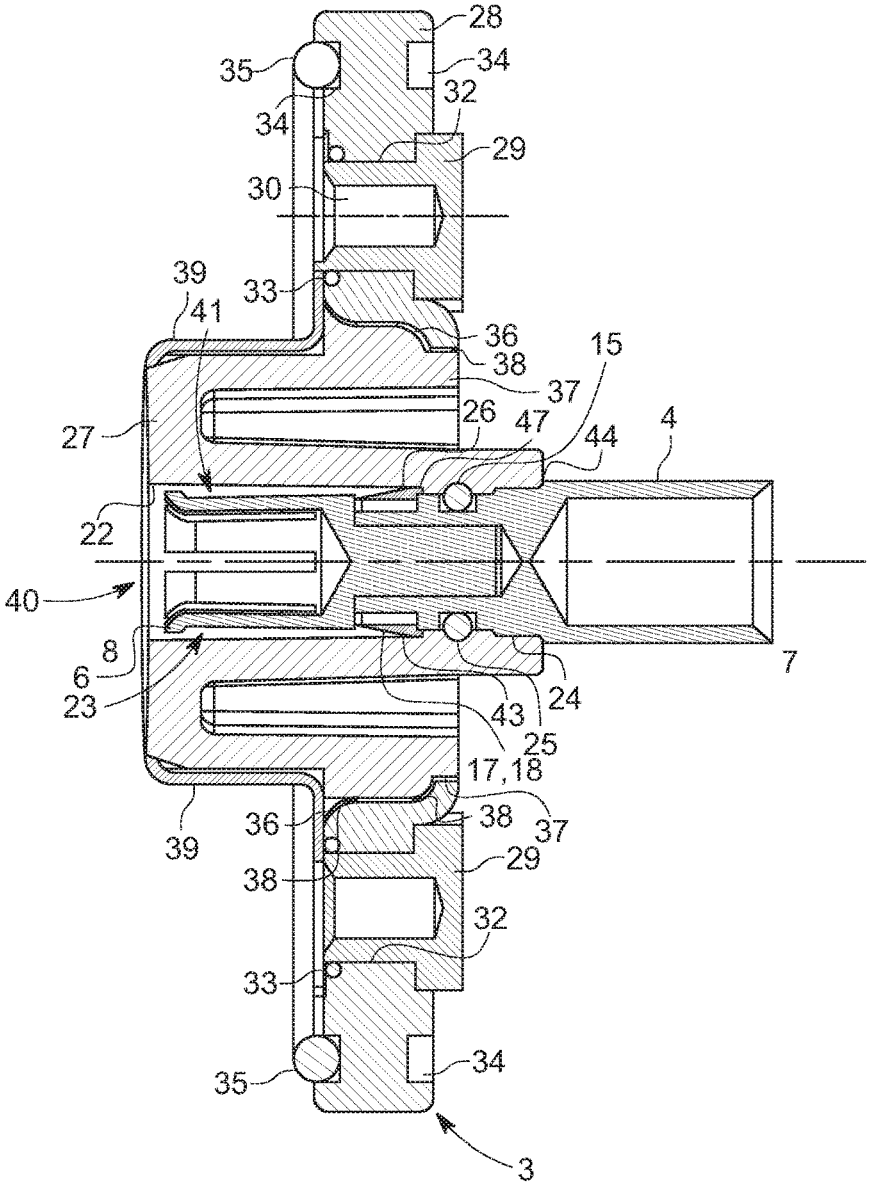
FIG. 8: the plug-in connector from FIG. 5 in a side sectional view.

The housing 3 comprises an insulating body 27, a sealing frame 28 surrounding the insulating body 27 and a shielding housing element 39. These are explained in more detail below (FIG. 8).

Figure 1:
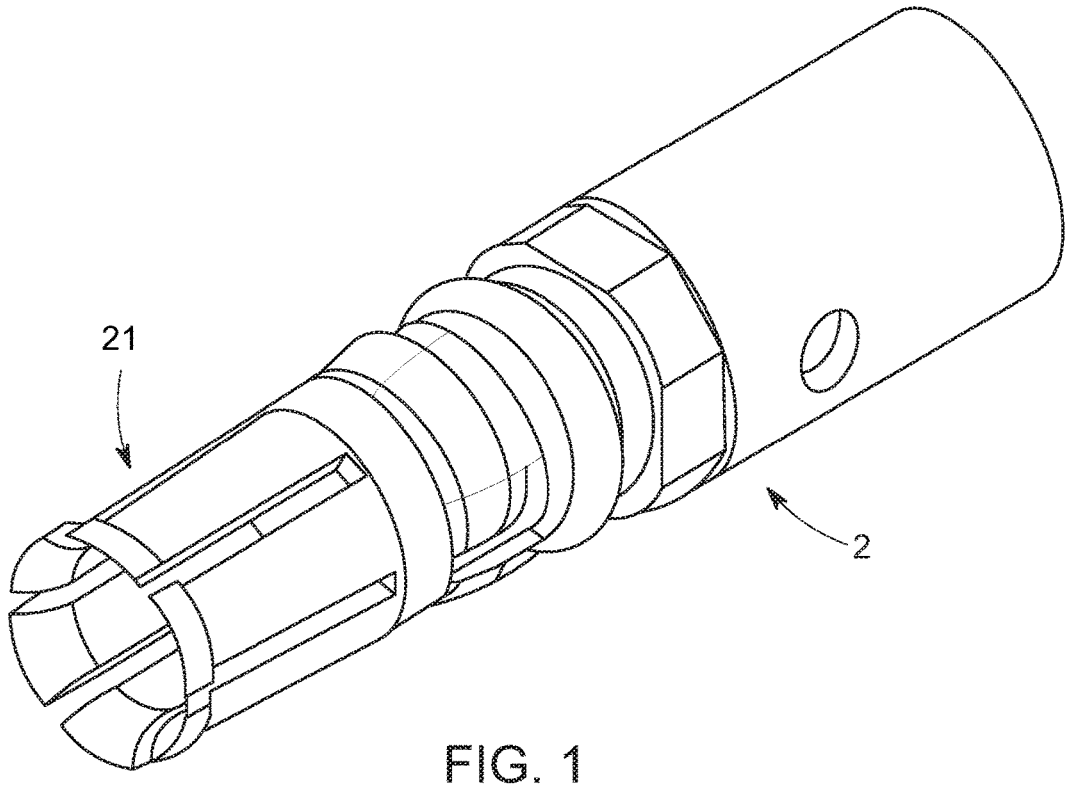
FIG. 1: an electrically conductive plug-in contact element of a plug-in connector according to the disclosure in a perspective view with a socket.
Figure 2:
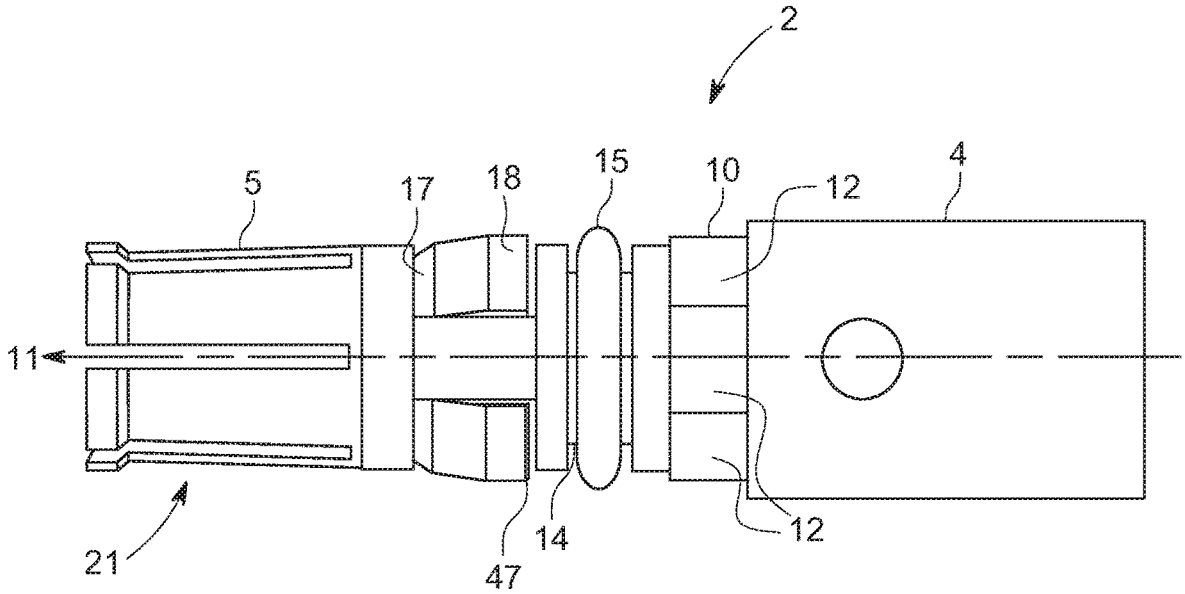
FIG. 2: the plug-in contact element from FIG. 1 in a side view.
Figure 3:
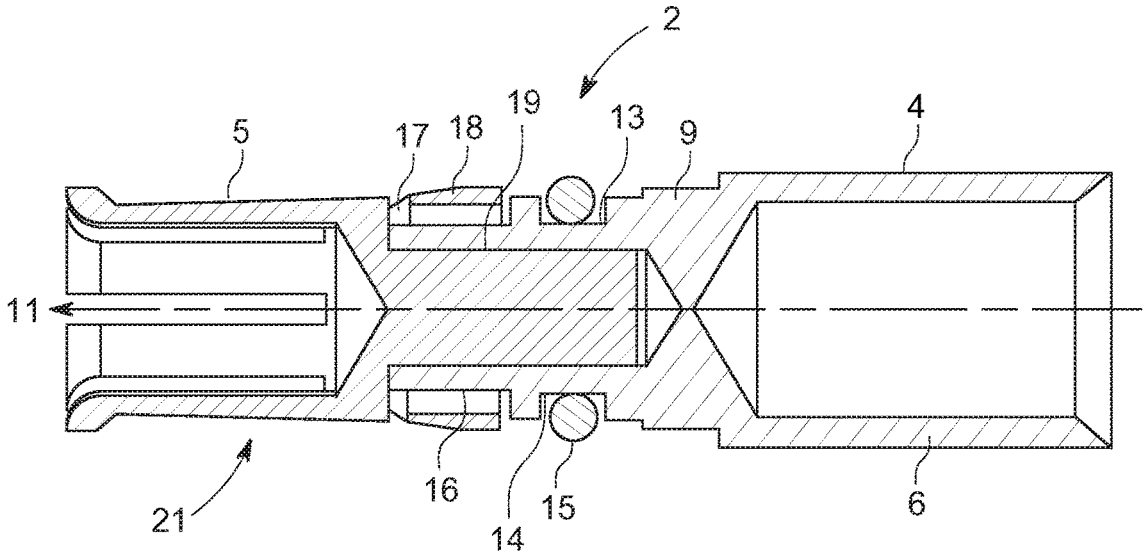
FIG. 3: the plug-in contact element from FIG. 2 in a side sectional view.

The structure of the electrically conductive plug-in contact element 2 in accordance with a first embodiment is described below first (FIGS. 1 to 3). According to this embodiment, the plug-in contact element 2 is formed in two parts from a crimp element 4 and a plug-in element 5. The crimp element 4 and the plug-in element 5 can be connected to one another at least in a frictional and/or force-fitting manner.

Instead of the crimp element 4, a solder section element can also be provided for establishing an electrical and mechanical connection to a cable.

The crimp element 4 comprises a tubular crimp section 6 for establishing an electrical and mechanical connection to a cable 42. The end of the plug-in contact element 2 forming the tubular crimp section 6 is referred to as the crimp-side end 7. According to this embodiment, the cable 42 is, for example, a 10 $mm^2$/AWG 8 grounding cable crimped onto the crimp section 6 forming a high-current contact.

An end of the plug-in contact element 2 opposite the crimp-side end 7 is referred to as the mating-side end 8.

From the crimp-side end 7 in the direction of the mating-side end 8, an approximately tubular anti-rotation section 9 is formed on the crimp element 4 after the tubular crimp section 6.

An outer wall 10 of the approximately cylindrical section of the anti-rotation section 9 has flattened, flat anti-rotation faces 12 running in parallel with respect to a central longitudinal axis 11 of the plug-in contact element 2. The anti-rotation faces 12 can be hexagonal or polygonal in form or have another shape suitable for anti-rotation protection, for example a toothing.

A sealing section 13 abuts on the anti-rotation section 9 in the direction of the mating-side end 8. The sealing section 13 has a radially circumferential groove or recess 14 in which a seal 15 is arranged. The seal 15 preferably takes the form of an O-ring.

At the mating-side end 8, a latching section 16 is provided in the plug-in direction after the sealing section 13. On the latching section 16, a retaining ring 17 with latching elements 18 arranged radially circumferentially and equally spaced from one another is provided. The latching elements 18 take the form of latching springs which have latching edges 47 at their rear ends in the plug-in direction.

In the region of the anti-rotation section 9, of the sealing section 13 and of the latching section 16, the crimp element 4 has a cylindrical recess extending in the plug-in direction 11. The cylindrical recess 19 takes the form of a blind hole and is open in the direction of the mating-side end 8.

A cylindrical section 20 of the plug-in element 5 is arranged or accommodated in this cylindrical recess 19. The cylindrical recess 19 of the crimp element 4 and the cylindrical section 20 of the plug-in element 5 are preferably connected to each other via a press fit. However, other suitable connections may also be provided in order to connect the cylindrical section 20 to the cylindrical recess 19 in the manner of a press fit.

According to an alternative embodiment, the plug-in contact element 2 can also be formed in one piece, that is to say, the crimp element 4 or the solder section element and the plug-in element 5 are formed from a single piece or are connected to one another in one piece or in a material-locking manner.

Figure 4:
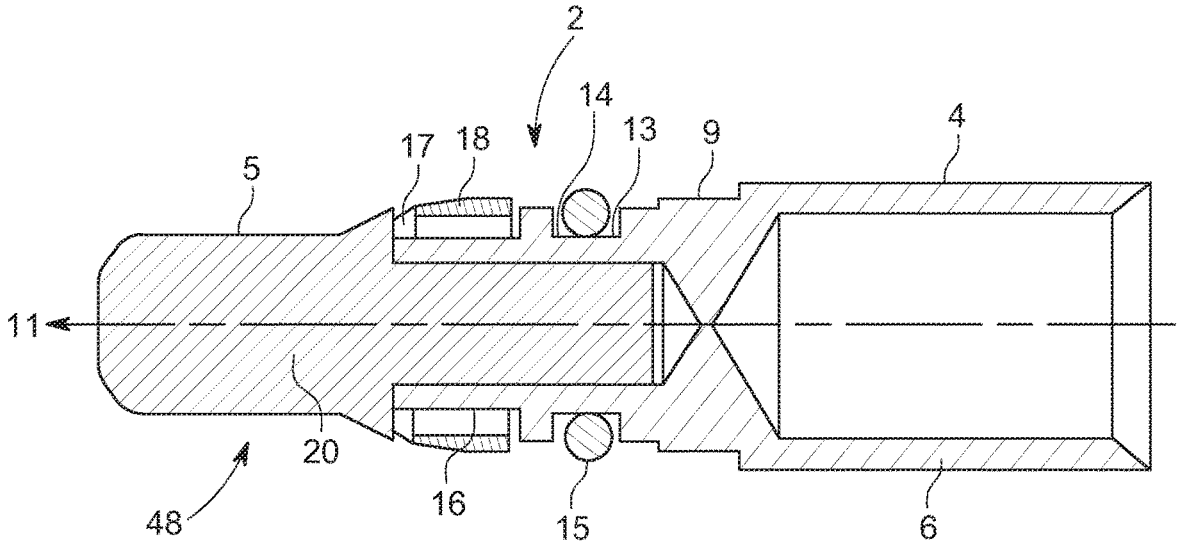
FIG. 4: the plug-in contact element from FIG. 2 in a side sectional view, wherein a pin is provided instead of a socket.
Figure 5:
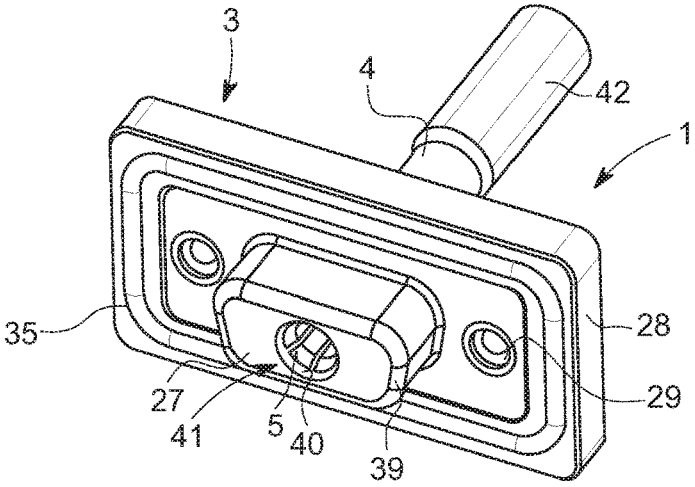
FIG. 5: the plug-in connector according to the disclosure in a perspective view with a socket.
Figure 6:
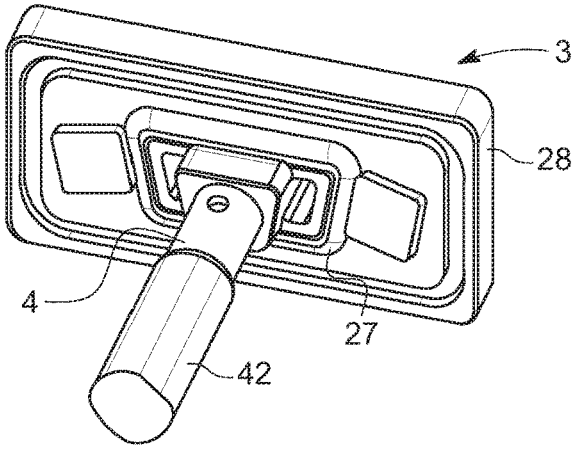
FIG. 6: the plug-in connector from FIG. 5 in a further perspective view.
Figure 7:
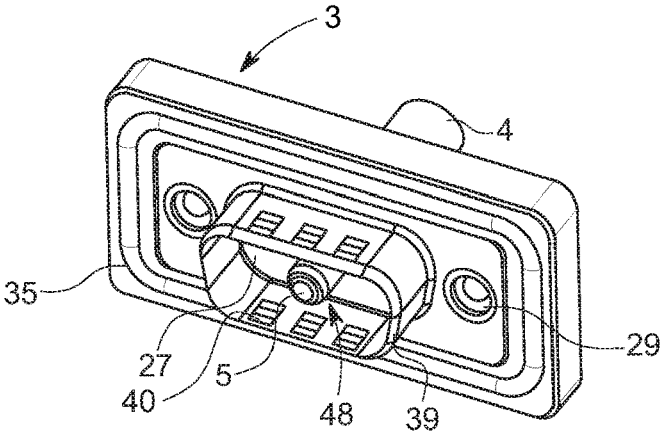
FIG. 7: the plug-in connector from FIG. 4 in a perspective view, wherein a pin is provided instead of a socket.

In the region of the mating-side end 8 of the plug-in element, the plug-in element 5 takes the form of a socket 21. Instead of a socket 21, the plug-in element 5 can also take the form of a pin 48 (FIGS. 4 and 7) in this region.

The two-part design of the plug-in contact element 2 makes it possible for the plug-in contact element to be designed inexpensively and with little effort either as a socket 21 or as a plug 48.

The plug-in contact element explained above is arranged in the housing 3, which is described in detail below (FIGS. 5 to 12).

The insulating body 27 of the housing 3 has a through-opening 22 extending in the plug-in direction 11. The through-opening 22 forms a plug-in contact element holder 23.

The housing 3 and the plug-in contact element 2 of the plug-in connector 1 are described below in the plug-in direction 11 from a crimp-side end 7 in the direction of a mating-side end 8.

In the region of the crimp-side end 7, the through-opening has an anti-rotation receiving section 24. In cross-section, the anti-rotation receiving section 24 is designed to correspond or be complementary to the anti-rotation section 9 of the plug-in contact element 2 in such a way that the anti-rotation section 9 of the plug-in contact element 2 is arranged in an approximately form-fitting manner in the anti-rotation receiving section 24 of the plug-in contact element holder 23 of the housing 3. In the context of the present disclosure, approximately form-fitting is understood to mean that a slight rotational movement by a few degrees between the anti-rotation section 9 and the anti-rotation receiving section 24 can be possible in order to facilitate insertion of the plug-in contact element 2 into the plug-in contact element holder 23.

An approximately cylindrical sealing section 25 abuts on the anti-rotation receiving section 24 in the direction of the mating-side end 8. In the sealing section 25 of the plug-in element holder 23 of the housing 3, the seal 15 of the plug-in contact element 2 is surrounded or enclosed by the sealing section 25 in such a way that the seal 15 seals the plug-in contact element 2 to the plug-in contact element holder 23.

With the plug-in connector 1 according to the disclosure, the plug-in contact element holder 23 designed as a through-opening 22 is sealed to the plug-in contact element 2 by means of the seal 15 in such a way that moisture cannot pass through the plug-in contact element holder 23.

A cylindrical recess 26 abuts on the sealing section 25 in the plug-in direction 11, in the direction of the mating-side end 8. The diameter of said recess is larger than the diameter of the sealing section, whereby an edge 43 is formed.

In the region of the crimp-side end 7 of this cylindrical recess 26, the retaining ring 17 of the plug-in contact element 2 is arranged such that the latching sections of the latching springs 18 of the retaining ring 17 abut on the edge 43 and prevent a movement of the plug-in contact element 2 in the insulating body 27 counter to the plug-in direction 11.

A movement of the plug-in contact element 2 in the insulating body 27 in the plug-in direction 11 is prevented by an edge 44 of the insulating body 27 on which a transition of the crimp section 6 to the anti-rotation receiving section 9 of the plug-in contact element abuts.

In the mating-side end region 8, the socket 21 of the plug-in contact element 2 is accommodated in the through-opening 22 of the housing 3 in such a way that sufficient radially circumferential play for operating the socket 21 is present. This region of the through-opening is designated as contact region 41.

The insulating body 27 of the housing 3 which receives or surrounds the plug-in element 2 is formed from an electrically insulating material, such as a glass-fiber-reinforced polymer.

The insulating body 27 is surrounded by the sealing frame 28 or connected thereto. The sealing frame 28 is formed, for example, from nickel-plated die-cast zinc or a similar material.

In particular, a region between the insulating body 27, the sealing frame 28 and the shielding housing element 39 is molded or crimped with a suitable sealant, such as silicone, in order to ensure one hundred percent tightness of the plug-in connector 1.

At least two threaded bushes 29 with corresponding threaded holes 30 are arranged in the sealing frame 28. An outer wall 31 of the threaded bush 29 is sealed to a bush recess 32 arranged in the sealing frame 28 for receiving the threaded bush 29 by means of a bush sealing ring 33. The bush recess 32 is preferably designed such that a threaded bush 29 can be inserted therein such that the threaded hole 30 is open in the direction of the crimp-side end 7 or in the direction of the mating-side end 8. The threaded bushes 29 take the form of rivets or riveting nuts and are accordingly connected to the sealing frame 28 in the manner of a riveted or press-fit connection.

Corresponding hexagonal screws 46 are provided for mounting the plug-in connector 1 or for connecting it to a housing 45.

In a radial edge region, the sealing frame 28 has an annular circumferential plug-in-surface sealing groove 34 open in the direction of the mating-side end 8 for receiving a plug-in-surface sealing ring 35. In addition and/or alternatively, a further plug-in-surface sealing groove 34 with an opening which points in the direction of the crimp-side end 7 and is likewise designed for receiving a plug-in-surface sealing ring 35 can also be provided.

The sealing frame 28 has a central recess 36 for receiving the insulating body 27. This recess 36 is approximately cup-shaped so that a receiving latching edge 37 which is formed on an outer wall 38 of the insulating body 27 prevents the insulating body 27 from shifting in relation to the sealing frame 28 in the direction of the crimp-side end 7.

In the mating-side end region 8, a movement of the insulating body relative to the sealing frame 28 is prevented by a flange-like shielding housing element 39. The shielding housing element 39 has an opening 40 which is located approximately centrally in the plug-in direction and through which a corresponding pin (not shown) can be inserted into the socket 21 of the plug-in connector 1. Furthermore, the shielding housing element 39 is formed from a metal sheet, for example from tin-plated brass.

In the region of the opening 40, the shielding housing element 39 forms a circumferential latching edge which prevents a movement of the insulating body 27 in the plug-in direction 11 in the direction of the mating-side end 8 of the insulating body 27 with respect to the sealing frame 28. In conjunction with a corresponding mating pin or mating socket, the shielding housing element forms a shielding.

The components of the plug-in connector, in particular the insulating body 27, the sealing frame 28 and the shielding housing element 39 are connected to one another by riveting the threaded bushes 29.

Figure 10:
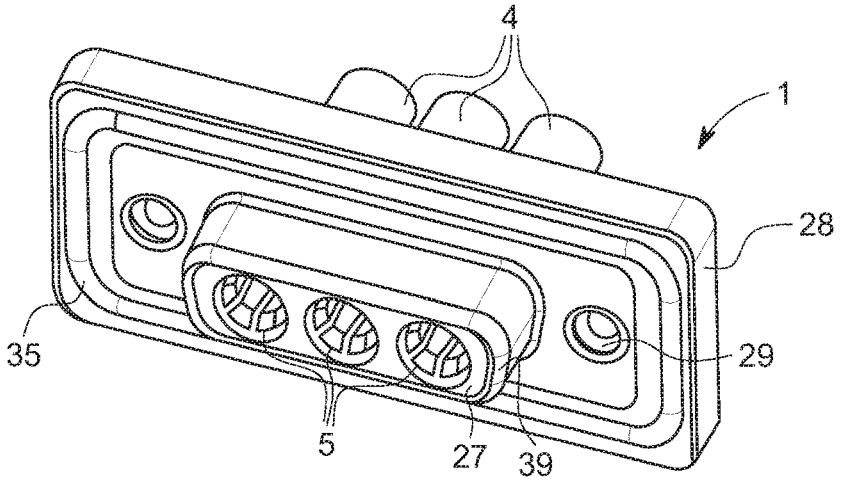
FIG. 10: a further embodiment of the plug-in connector according to the disclosure with three electrically conductive plug-in contact elements in a perspective view.
Figure 11:
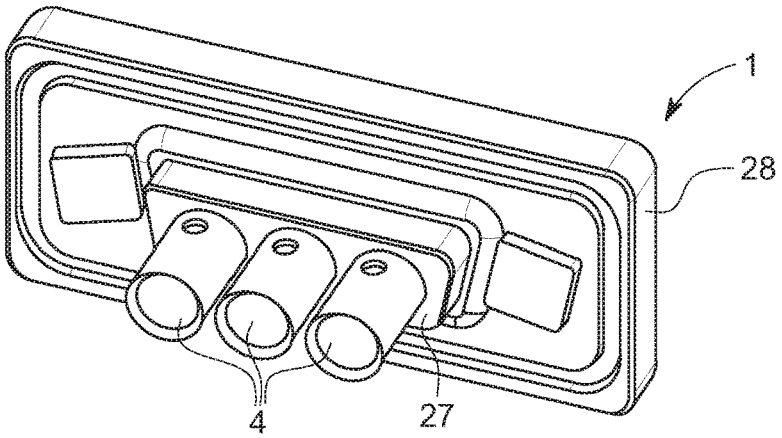
FIG. 11: the plug-in connector from FIG. 10 in a further perspective view.
Figure 12:
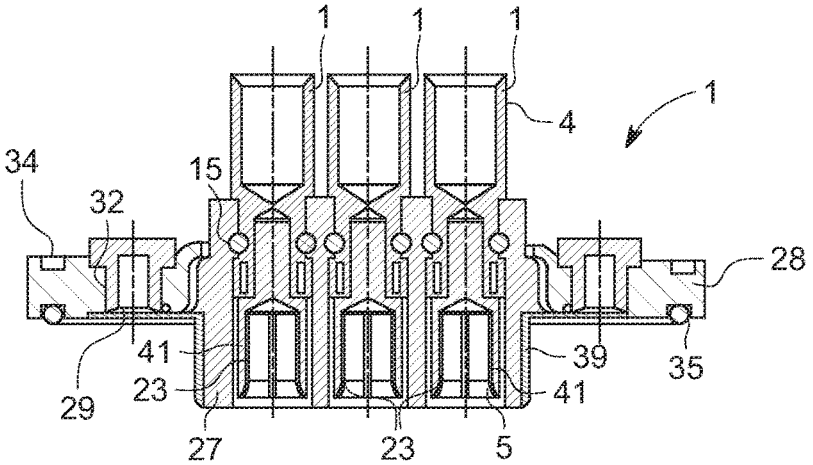
FIG. 12: the plug-in connector according to FIG. 10 in a side sectional view.

According to a further embodiment of the plug-in connector 1 according to the disclosure, which has a design analogous to the first embodiment of the plug-in connector 1, three plug-in contact elements 2 arranged next to one another are provided instead of one plug-in contact element 2 (FIGS. 10 to 12).

Accordingly, the insulating body 27 has three through-openings 22 which have a design analogous to the through-openings 22 according to the first embodiment and accordingly form three plug-in contact element holders 23 (FIGS. 10 to 12).

Figure 9:
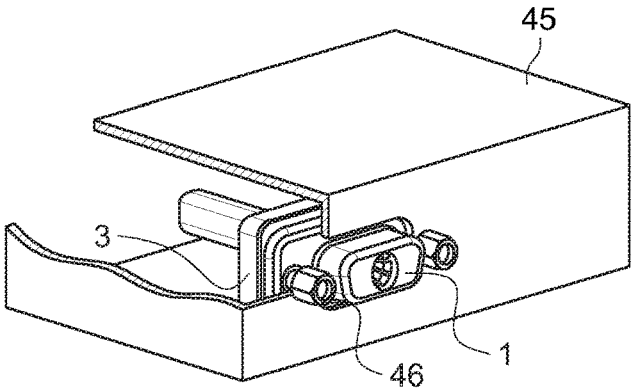
FIG. 9: the plug-in connector in a state mounted in a housing.

A plug-in connector 1 according to the disclosure can be arranged, for example, in a booth wall (not shown) of a booth or in a housing 45, the sealing frame 28 being sealed to a housing wall by means of the plug-in surface sealing ring 35 (FIG. 9). As a result of the different arrangement of the two plug-in surface sealing grooves and the threaded bushes, it is possible to connect the plug-in connector 1 according to the disclosure to a booth wall with any orientation as required.

The plug-in connector 1 according to the disclosure can thus form a single- or multi-pole plug-in connector system for potential equalization.

The majority of electrical drive systems for variable speed have an earth leakage current greater than 3.5 mA AC.

In the event that an earth leakage current is more than 10 mA AC or DC, a protective conductor connected to the plug-in connector according to the disclosure has a minimum cross-section of 10 $mm^2$ Cu or 16 $mm^2$ Al over its entire length.

The plug-in connector according to the disclosure meets at least the requirements of IP66 in the plugged-in and unplugged states, which means that moisture must not penetrate into the device via the plug-in connector. The plug-in connector is accordingly watertight.

Furthermore, due to the plug-in-surface sealing grooves 34 being formed on both sides and the plug-in-surface sealing ring being arranged therein, the sealing frame is designed both for a rear-side mounting (FIG. 9) and a front-side mounting (not shown).

The high-current contact of the plug-in contact element can form a straight cable connection with at least AWG 8. The current load is at most 10 mA.

A grounding cable connected thereto has accordingly a cross-sectional area of 10 $mm^2$.

The operating temperature of the plug-in connector is in the range of −25° C. to +70° C.

The invention claimed is:

1. Plug-in connector, in particular for a high-current application, with an electrically conductive plug-in contact element and an electrically insulating housing, the housing having at least one through-opening forming a plug-in contact element holder for receiving the plug-in contact element, the plug-in contact element holder surrounding the plug-in contact element at least in regions and a seal being provided in the region in which the plug-in contact element holder surrounds the plug-in contact element so that the seal seals the plug-in contact element holder to the plug-in contact element, and the plug-in contact element having a crimp section for establishing an electrical and mechanical connection to a cable, wherein the plug-in contact element has a latching element and the corresponding plug-in contact element holder has a mating latching element so that the plug-in contact element is latched and held in the plug-in contact element holder to prevent a movement of the plug-in contact element counter to a plug-in direction, the plug-in contact element being formed from a crimp element and a plug-in element which are connected to one another by means of a press fit prior to insertion into the housing.

2. Plug-in connector according to claim 1, wherein the plug-in connector has a plurality of plug-in contact element holders, in each of which a plug-in contact element is arranged, and the plug-in contact element holders are sealed to the plug-in contact element.

3. Plug-in connector according to claim 1, wherein the seal is an O-ring.

4. Plug-in connector according to claim 1, wherein the housing has a plug-in surface which, when in a state connected to a mating plug-in connector, faces the mating plug-in connector, wherein a circumferential plug-in-surface seal is arranged on the plug-in surface and abuts on a corresponding mating surface in the plugged-in state.

5. Plug-in connector according to claim 1, wherein the plug-in contact element and the corresponding plug-in contact element holder have a positive fit so that the plug-in contact element is arranged in the plug-in contact element holder so as to be secure against rotation.

6. Plug-in connector according to claim 5, wherein the plug-in contact element has an approximately cylindrical section flattened with flat surfaces and the plug-in contact element holder is correspondingly shaped so that the positive fit is formed as a result.

7. Plug-in connector according to claim 1, wherein the plug-in contact element comprises a pin or a socket.

8. Plug-in connector according to claim 1, wherein the plug-in contact element has a cross-sectional region of at least 5 $mm^2$ and preferably of at least 8 $mm^2$.

9. Plug-in connector according to claim 1, wherein the crimp element has a cylindrical recess extending in the plug-in direction and the plug-in element has a correspondingly shaped cylindrical section, or vice versa, so that the cylindrical recess of the crimp element and the cylindrical section of the plug-in element are connected to one another via the press fit.

10. Plug-in connector according to claim 1, wherein a shielding housing element is provided, wherein the shielding housing element has an opening located approximately centrally in the plug-in direction, through which opening a corresponding pin can be inserted into a socket of the plug-in connector 1.

11. Plug-in connector according to claim 10, wherein the shielding housing element is formed from a metal sheet, for example zinc-plated brass, and wherein the shielding housing element in conjunction with a corresponding mating pin or a mating socket forms a shielding for the plug-in connector.

* * * * *